United States Patent [19]

McHale

[11] Patent Number: 4,856,240

[45] Date of Patent: Aug. 15, 1989

[54] METHOD FOR FORMING A SOIL MOISTURE BARRIER IN A STUCCO WALL AND STUCCO WALL INCORPORATING SAME

[76] Inventor: James J. McHale, 1207 Branding Iron Cir., Vista, Calif. 92083

[21] Appl. No.: 179,975

[22] Filed: Apr. 11, 1988

[51] Int. Cl.[4] ..... E02D 27/48

[52] U.S. Cl. ..... 52/169.14; 52/745; 52/169.5

[58] Field of Search ..... 52/58–64, 52/169.5, 169.14, 744, 741

[56] References Cited

U.S. PATENT DOCUMENTS

| | | | |
|---|---|---|---|
| 2,050,798 | 8/1936 | Kothe | 52/62 X |
| 2,274,647 | 3/1942 | Auard et al. | 52/58 |
| 3,754,362 | 8/1973 | Daimler et al. | 52/169.14 X |

FOREIGN PATENT DOCUMENTS

| | | | |
|---|---|---|---|
| 2904541 | 8/1980 | Fed. Rep. of Germany | 52/169.14 |
| 815193 | 3/1981 | U.S.S.R. | 52/744 |

OTHER PUBLICATIONS

*American Builder,* May 1959, "Technical Guide from the Month of May—13 Ways Premoulded Membrane Gives 'Hidden Value' Protection . . . ".

*Primary Examiner*—David A. Scherbel
*Assistant Examiner*—Richard E. Chilcot, Jr.
*Attorney, Agent, or Firm*—Brown, Martin, Haller & McClain

[57] ABSTRACT

A method for retarding the leaching of liquid-borne minerals and salts in a stucco wall comprising the steps of, forming a slot of a predetermined depth along said wall, inserting a water impervious material into said slot, and forming a patch over said slot.

23 Claims, 2 Drawing Sheets

METHOD FOR FORMING A SOIL MOISTURE BARRIER IN A STUCCO WALL AND STUCCO WALL INCORPORATING SAME

BACKGROUND OF THE INVENTION

I. Field of the Invention

The present invention relates to stucco walls. More specifically, the present invention relates to a novel and improved method of forming in a stucco wall a barrier to prevent the upward leaching of water-borne minerals and salts from the soil through the stucco wall.

II. Description of the Related Art

In many types of building structures stuccoing is one method of forming the exterior walls. Buildings which include stucco walls are typically residences and smaller commercial buildings. Stuccoing is preferred in many locations due to its inherent durability and ability to incorporate aesthetically appealing textures and colors.

In fabricating a building which will include an exterior stucco wall, a concrete foundation footing is formed about the perimeter of the building where the exterior walls are to be located. The footing typically extends downward below the soil level adjacent the building.

A wooden floor joist plate is then typically affixed to the top of the footing. Wooden studs are then horizontally positioned upon and affixed to the joist plate as is well known in conventional construction framing techniques. A lath layer is then formed over the studs. The lath layer is typically comprised of a layer of tar paper that is stapled or nailed to the studs. Overlying the tar paper, a metal wire mesh or screen is also stapled or nailed to the papered studs. The paper and wire mesh respectively provide a substantially water-tight backing and carrier for the stucco.

A base layer or "brown coat" of stucco is typically applied directly against the lath layer. The stucco base layer is typically applied by spraying the stucco material directly upon the lath layer. The stucco base layer is formed from a mixture typically comprised water mixed with four parts of sand and one part of cement. Various other materials or compositions may be added to the mixture to achieve various results. Water is added to the base layer mixture to provide a vehicle for application of the stucco. The base layer is typically applied to achieve a thickness of approximately three-quarters of an inch. Subsequent to the application of the stucco mixture to the lath layer, the water begins to dry out of the mixture resulting in the hardening of the stucco base layer.

An outer layer of stucco, also known as a "finish coat"or "color coat", is then applied to the base layer. The stucco outer layer is typically applied by spraying a mixture forming the stucco outer layer directly upon the stucco base layer. The stucco outer layer is formed from a mixture typically comprised water mixed with three parts of sand, one part of cement and one part of lime. Various other materials or compositions may also be added to the mixture to achieve various results. For example, pigments may be added to the mixture to give color to the finish. Water is again added to the outer layer mixture to provide a vehicle for application of the stucco. The outer layer is typically applied to achieve a thickness of approximately one-eighth of an inch. Subsequent to the application of the stucco mixture to the base layer, the water begins to dry out of the mixture resulting in the hardening of the stucco outer layer.

The addition of one part of lime, in combination with the reduction of one part of sand, to the mixture of the stucco outer layer, as compared to mixture of the stucco base layer, serves to increase the density of the stucco outer layer. The increase in density of the stucco outer layer gives it an enhanced resistance to the moisture. Correspondingly, the porosity and the ability of moisture to travel in the stucco base layer is greater than that of the stucco outer layer.

In the construction of older structures, especially homes, the lath layer extends downwardly along the footing below the soil level. The stucco base and outer layers are then applied to the lath layer, also extending below the soil level. As construction of the structure is completed the soil is pushed up against the stucco outer layer.

As time goes by, moisture from the soil is able to seep beneath the bottom of the stucco outer layer and into the stucco base layer. If the foundation footing is constructed with a foot portion, the moisture may seep between the foundation foot portion and the bottom of the stucco outer layer into the stucco base layer. This moisture that seeps into the stucco base layer contains mineral and salts that originated from the soil. The moisture travels upwardly generally only in the stucco base layer due to its lower porosity than that of the stucco outer layer. Soil moisture is known to travel in the stucco base layer upwardly from the soil level until an evaporation point is reached. The evaporation point is typically on an average of three feet, and on occasion up to five feet, from the soil level.

The minerals and salts that are carried by the moisture through the stucco base layer is damaging to both the stucco base and outer layers. Over time, the moisture leaches from the stucco base layer through to the stucco outer layer. The evaporation of the moisture leaves the minerals and salts remaining in the stucco layers. The remaining minerals and salts cause a deterioration of the stucco layers. These minerals and salts typically appear as an efflorescence upon the outer stucco layer.

In the construction of more modern homes, a device called an FHA screed is installed under the lath layer at the floor joist plate line. The screed is typically affixed to the floor joist plate by nails extending into the floor joist plate. The screed is intended to be used in applications where the soil level is below the floor joist plate line. The stucco layers are then applied to the lath layer which ends at a top portion of the screed. The lath layer and stucco layers, therefore, do not extend below the screed. The footing, which is typically not constructed to be aesthetically appealing, is therefore exposed in the region below the screed and above the soil level.

Several attempts have been made to use the screed in the re-stuccoing of older homes which have the stucco layers extending below the soil level. The use of the screed is to prevent damage to the stucco layers as a result of the upward leaching of soil minerals and salts as previously discussed. The attempts in using the screed in the restuccoing of this type of older homes has been unsuccessful for several reasons.

One reason that the screed is undesirable in the restuccoing of older homes is that the waterproof integrity of the lath layer is compromised. To affix the screed to the floor joist plate, the lath layer must be removed in the region about the floor joist plate. Removal of the lath layer can result in a potential path for moisture to leak into the framing structure.

In other re-stuccoing applications, the screed is not a preferred mechanism to prevent stucco damage from soil originated moisture. The screed is intended to be used where no stucco extend below the screed. In certain homes, such as historical landmarks or homes that the owners desire to retain the original appearance, the use of the screed would permit the footing to be exposed below the floor joist plate line. In these situations, the use of the screed where the structure has a high floor joist plate line relative to the soil line would greatly detract from the appearance of the structure.

In other re-stuccoing applications the screed cannot be used. These cases arise where the floor joist plate line is below soil level. The screed is intended to be affixed to the wall at the floor joist plate line. The use of the screed affixed to a wall having a floor joist plate line below soil level does not prevent soil moisture from penetrating the stucco base layer between the screed and the stucco outer layer. In addition, soil moisture may seep into the wall framing by violation of the integrity of the lath layer by the insertion of the screed under the lath layer.

It is, therefore, an object of the present invention to provide a novel and improved method for retarding damage to stucco walls from water-borne minerals and salts emanating from the soil.

It is another object of the present invention to provide a method for forming in a stucco wall a barrier to moisture leaching in the stucco layers.

It is yet another object of the present invention to provide a method for constructing a soil moisture barrier in the stucco so as to retain the original external appearance of the wall.

It is still a further object of the present invention to provide an improved soil moisture barrier for a stucco wall.

SUMMARY OF THE INVENTION

The present invention is a novel and improved method for retarding the leaching in stucco walls damaging soil moisture-borne minerals and salts. The present invention encompasses the aspect of in a stucco wall having a layer of stucco formed upon a lath layer, wherein the stucco layer contacts soil adjacent a bottom of the wall, a method for retarding the upward leaching of water-borne minerals and salts from the soil in the stucco layer.

The method includes forming a substantially continuous slot in the stucco layer along an exterior surface of the wall in a region adjacent the soil. The slot is formed so at to extend at a depth into the wall proximate the lath layer.

A strip of a non-porous material is positioned into and along the length of the slot. A water-resistive coating material is disposed within the slot. The slot is then covered with a strip of mesh-like material. To complete the construction of the soil moisture leaching retarding structure a patch layer of a stucco-based material is applied upon the mesh-like material and the exterior surface of the wall immediate the slot.

In further re-stuccoing of the wall at least one additional layer of stucco may be applied over the pathched slot region and the entire wall.

BRIEF DESCRIPTION OF THE DRAWINGS

Other features, objects and advantages of the present invention will become more apparent from the detailed description of the preferred embodiments of the present invention in which like reference characters correspond throughout and wherein.

DETAILED DESCRIPTION OF THE PREFERRED EMBODIMENTS

Figure 1:
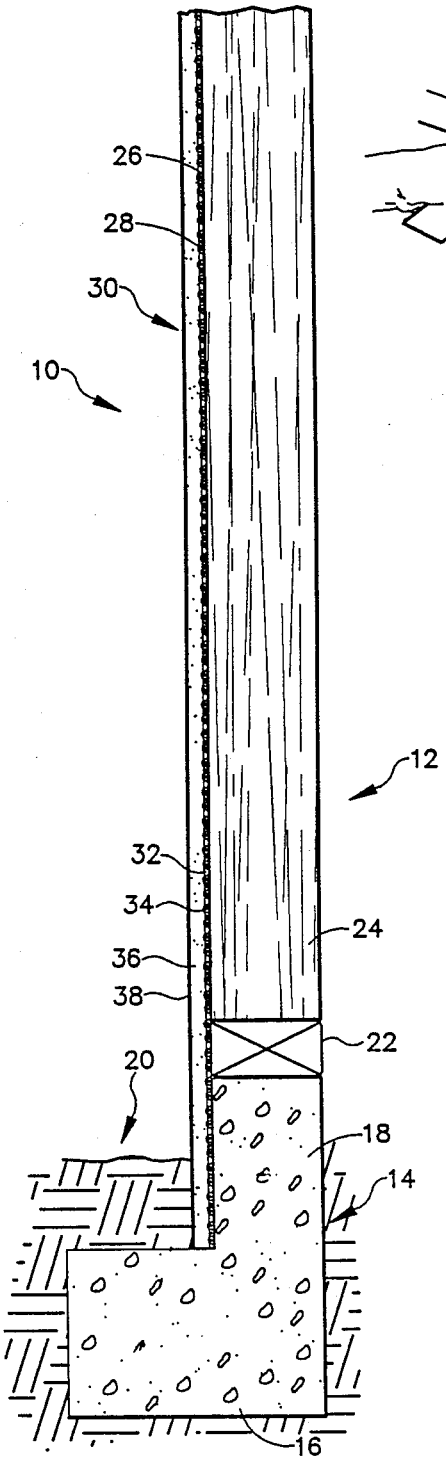
FIG. 1 is a partial sectional view of a building structure having a stucco wall.

Referring now to the drawings, FIG. 1 illustrates a typical stucco wall 10 built upon a framing assembly 12 and foundation footing 14. In FIG. 1, foundation footing 14 is illustrated as being an L-shaped member formed of concrete. Foundation footing 14 typically includes lower foot portion 16 and extending upwardly therefrom an upper leg portion 18. Foot portion 16 is typically buried beneath the soil 20 while leg portion 18 extends upwardly usually above the soil level.

Mounted upon foundation footing 18 is framing assembly 12. Framing assembly 12 includes floor joist plate 22 mounted upon the top of leg portion 18. Extending upwardly from floor joist plate 22 are a series of spaced-apart studs 24. Both floor joist plate 22 and studs 24 are typically wooden as is commonly used in the construction industry.

Formed upon an outer edge or surface 26 of studs 24, floor joist plate 22 and leg portion 18 is stucco wall 10. Stucco wall 10 consists of a lath layer 28 adjacent surface 26 and a stucco layer 30 formed upon lath layer 28.

Lath layer 28 is comprised of a paper layer 32, typically a tar paper material traditionally used in the construction industry. Lath layer 28 is affixed to outer surface 26 of stud 24 and floor joist plate 22 while extending below floor joist plate 22 along foundation footing 14. Affixed to paper layer 32 is a metallic wire mesh 34. Stucco layer 30 is formed directly upon lath layer 28. Stucco layer 30 includes stucco base layer 36 formed upon wire mesh 34 and paper layer 32. Stucco layer 30 further includes stucco outer layer 38 formed upon base layer 36.

Figure 2:
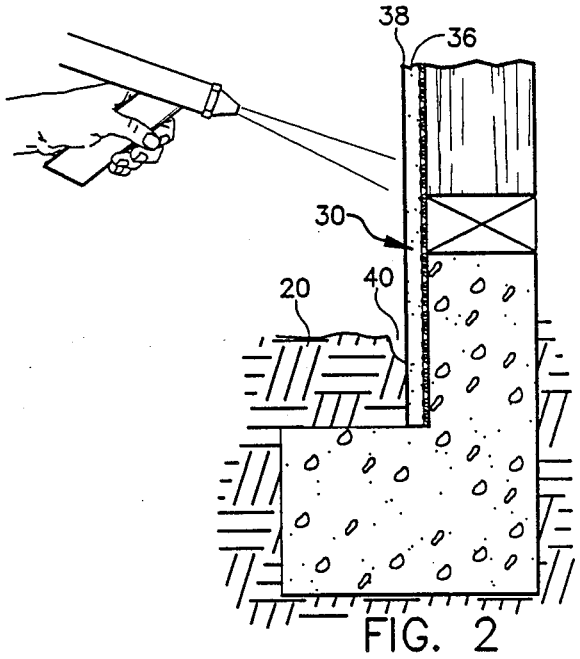
FIG. 2 is a partiall sectional view of the wall of FIG. 1 illustrating the preparation of the exterior stucco surface.
Figure 3:
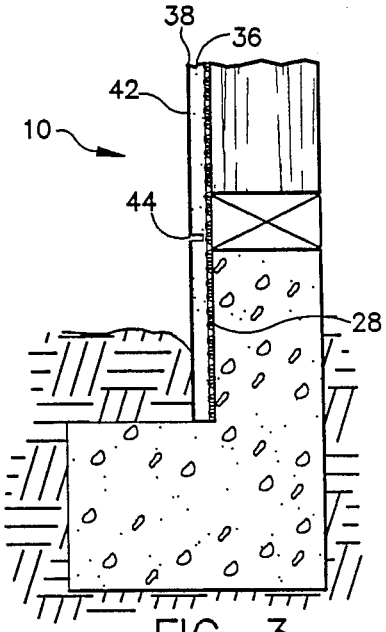
FIG. 3 is a partial sectional view of the wall of FIG. 1 illustrating a slot formed in the stucco wall.

In FIG. 2, the re-stuccoing process is begun by removing efflorescense, paint and decayed stucco outer and base layers. This process is usually accomplished by sandblasting as illustrated in FIG. 2 or by other techniques such as scraping. A portion of soil 20, portion 40, may be removed from along the base of stucco layer 30 to permit the restuccoing to extend below the existing soil level. As illustrated in FIG. 2, the bottom of stucco layer 30 may extend all the way down to the top of foot portion 16. As discussed previously, the extension of stucco layer 30 below the soil level permits water-borne minerals and salts to travel base layer 30 upwardly through the stucco layer as previously discussed.

Once outer surface 42 of the stucco layer 30 has been cleaned and decayed stucco repaired, the process for installing the soil moisture shield of the present invention into stucco wall 10 is begun. A chalk line mark is made along the wall typically in the region about floor joist plate 22. Slot 44 is formed along the chalk line mark on stucco wall 10 from outer surface 42 through outer layer 38 and into base layer 36. However, slot 44 may be formed above or below the level of floor joist plate 22. Slot 44 is preferably formed above the level of soil 20 for optimum performance of the soil moisture shield of the present invention.

Base layer 36 is typically three-quarters of an inch thick while outer layer 38 is typically approximately one-eighth of an inch thick. Slot 44 is typically formed by a saw which cuts into stucco layer 30. One method of forming slot 44 is by using a circular saw having a carbide or diamond tipped blade or other type of blade capable of cutting stucco. Slot 44 is approximately one-eighth inch in height and approximately three-quarters inch in depth in stucco layer 30. It is preferred that the depth of slot 44 be insufficient to contact wire mesh 34 or paper 32 so as to prevent violation of the waterproof integrity of lath layer 28.

Figure 4:
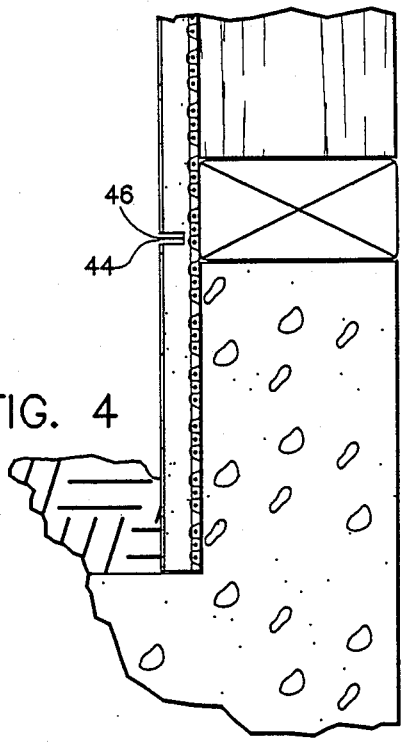
FIG. 4 is an enlarged partial sectional view of the wall of FIG. 1 illustrating the insertion of a barrier strip into the slot.

Referring to FIG. 4, a barrier strip of nonporous materials having a width of approximately five-eighth inches is inserted into slot 44. Strip 46 is typically formed of polypropylene or any other type of nonporous plastic material. In the alternative, strip 46 may be formed of a metal such as galvanized steel or any other non-corroding metallic material. It is envisioned that on occasion it may be necessary to use nails to secure strip 46 within slot 44.

Figure 5:
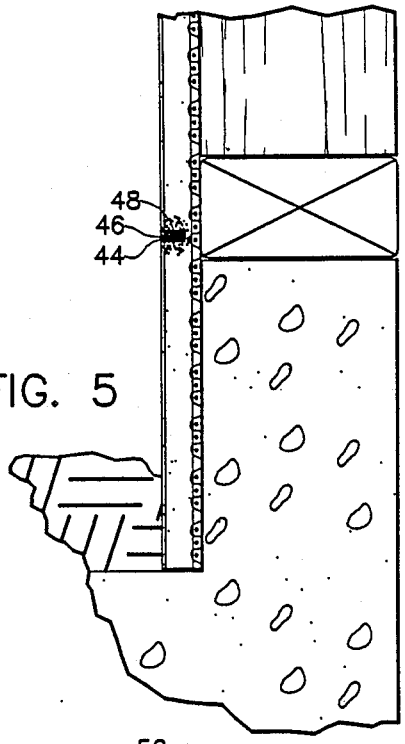
FIG. 5 is an enlarged partial sectional view of the wall of FIG. 1 illustrating the application of a coating material into the slot about the strip.

Referring to FIG. 5, a liquid coating material that is impervious to the penetration of water is flooded within slot 44 about strip 46. Although many various caulking materials and gels impervious to water, such as a silicon gel caulking material, may be used, it is preferred that a concrete and plaster adhesive that provides an acrylic plastic coating be used. There are many commercially available water-based, air-drying, high-solid content acrylic powder emulsions which may be disposed within slot 44 by a pressurized nozzel. Such an adhesive soaks into the stucco layers and upon drying provides a water impervious barrier about inner surfaces of slot 44.

Figure 6:
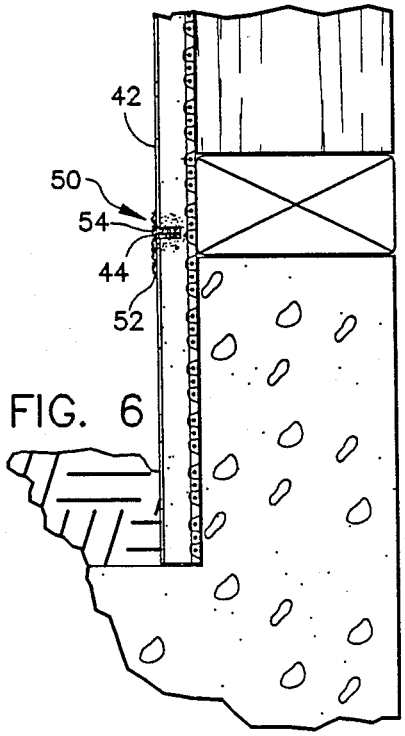
FIG. 6 is an enlarged partial sectional view of the wall of FIG. 1 illustrating the application of a patch layer upon the stucco wall in the region about the slot.

In FIG. 6, a patch 50 is formed over slot 44 and upon outer surface 42 adjacent slot 44. Patch layer 50 comprises a strip of adhesive-backed fiberglass mesh 52 or other suitable mesh-like material that is positioned over slot 44 and the area immediately adjacent slot 44 on outer surface 42. A mixture of stucco and luminite, i.e. calcium aluminate, forms a patching compound that is applied as layer 54 upon mesh 52 and upon outer surface 42 about mesh 54. Luminite is added to the stucco patch mixture as a hardening agent to prevent shrinkage and cracking of the stucco patch mixture as it dries.

Figure 7:
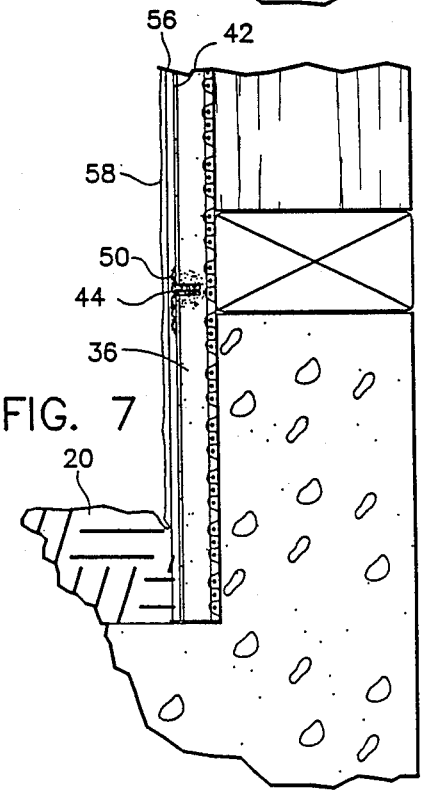
FIG. 7 is an enlarged partial sectional view of the wall of FIG. 1 illustrating the application of replacement stucco layers over the patch layer and preexisting stucco wall.

Referring to FIG. 7, a first new outer layer of stucco, replacement layer 56, approximately one-sixteenth inch thick, is applied to outer surface 42 and patch layer 50. Replacement layer 56 may include color pigmentation if desired. Replacement 56 is typically of the same stucco composition in mixture as that of outer layer 38. Replacement layer 56 is typically permitted to dry approximately fifteen minutes to one and one-half hours until it achieves a stiffness sufficient to permit application of a texturizing finish layer, finish layer 58. Finish layer 58 is of a thickness of approximately onesixteenth of an inch when applied upon replacement layer 56. Finish layer 58 may also be of the same stucco mixture as that of replacement layer 56, with pigmentation added for color. Upon hardening of finish layer 58, soil 20 may be pushed against the re-stuccoed wall structure directly against finish layer 58.

The area within and about slot 42 provides a barrier against the travel of moisture upwardly through base layer 36 beyond slot 44. Therefore, the evaporation point of the wall is limited to that about slot 44. Any efflorescense that occurs, as a result of moisture travel in layers 36 from soil 20, will extend no higher than below slot 44. In this application, major damage to higher up in the wall structure may be avoided while limiting stucco decay to a small area below slot 44.

The previous description of the preferred embodiments are provided to enable any person skilled in the art to make or use the present invention. Various modifications to these embodiments will be readily apparent to those skilled in the art, and the generic principles defined herein may be applied to other embodiments without the use of the inventive faculty. Thus, the present invention is not intended to be limited to the embodiments shown herein, but is to be accorded the widest scope consistent with the principles and novel features disclosed herein.

I claim:

1. A method for retarding the leaching of liquid-borne minerals and salts in a stucco wall comprising the steps of:
   - forming a slot of a predetermined depth along said wall;
   - inserting a water impervious material into said slot; and
   - forming a patch upon said wall overlaying said slot and overlapping said wall adjacent said slot.

2. The method of claim 1 wherein said stucco wall has an exterior surface and a bottom with said exterior surface intersecting soil in the region adjacent said bottom, said slot being formed in said stucco wall at said exterior surface in a region above where said exterior surface intersects said soil.

3. The method of claim 1 wherein said step of inserting said water impervious material into said slot further comprises the steps of:
   - inserting a strip of non-porous material within said slot; and
   - disposing an acrylic stucco bonding agent within said slot about said strip.

4. The method of claim 1 wherein said step of forming a patch over said slot further comprises the steps of:
   - applying a strip of a mesh-like material over said slot; and
   - applying a stucco-based material upon said mesh-like material and upon said wall in a region about said slot.

5. In a stucco wall having a layer of stucco formed upon a lath layer wherein said stucco layer contacts soil adjacent a bottom of said wall, a method for retarding the upward leaching of water-borne minerals and salts from said soil in said stucco layer comprising the steps:

forming a substantially continuous slot in said stucco layer along an exterior surface of said wall in a region adjacent said soil, said slot extending a depth into said wall proximate said lath layer;

positioning a strip of a non-porous material into and along the length of said slot;

disposing a water-resistive coating material within said slot;

covering said slot with a strip of mesh-like material; and applying a patch layer of a stucco-based material upon said mesh-like material.

6. The method of claim 5 further comprising the step of applying at least one additional stucco layer over said patch layer and said stucco layer.

7. The method of claim 5 wherein said stucco layer is comprised of a base layer formed upon said lath layer and an outer layer formed upon said base layer, said base layer being of a thickness greater than said outer layer with said outer layer being of a higher density and lower porosity than said base layer, said slot formed through said outer layer and extending into said base layer.

8. The method of claim 5 wherein said strip of non-porous material positioned in said slot is formed of plastic.

9. The method of claim 5 wherein said strip of non-porous material positioned in said slot is formed of galvanized steel.

10. The method of claim 5 wherein said water-resistive coating material disposed within said slot is a water-based acrylic adhesive.

11. The method of claim 5 wherein said slot is covered by said strip of mesh-like material formed of fiber glass.

12. The method of claim 5 wherein said step of forming said slot further comprises the step of cleaning said exterior surface of said wall.

13. The method of claim 12 wherein said step of forming said slot further comprises the step of providing a substantially straight slot indicator line to said exterior surface, said slot being formed in said stucco layer substantially along said slot indicator line.

14. In a building having a stucco wall formed of a layer of stucco formed upon a lath layer wherein said stucco layer contacts soil, a moisture shield for preventing the upward migration of water-borne minerals and salts from said soil in said stucco layer, said moisture shield comprising:

a strip of non-porous material material disposed within and along a continuous slot formed in said stucco layer along an exterior surface of said wall in a region adjacent said soil, said slot extending into said stucco layer of a predetermined depth proximate said lath layer;

a water-resistant coating material disposed within said slot about said non-porous material strip;

a strip of mesh-like material affixed to said exterior surface of said wall overlying said slot; and a patch layer formed from a stucco-based material disposed upon said strip of mesh-like material and a region immediate thereto upon said exterior surface of said wall.

15. The moisture shield of claim 14 further comprising at least one additional stucco layer formed upon said patch layer and said stucco layer.

16. The moisture shield of claim 14 wherein said stucco layer is comprised of a base layer formed upon said lath layer and an outer layer formed upon said base layer, said base layer being of a thickness greater than said outer layer with said outer layer being of a higher density and lower porosity than said base layer, said slot formed through said outer layer and extending into said base layer.

17. The moisture shield of claim 14 wherein said strip of non-porous material is formed of plastic.

18. The moisture shield of claim 14 wherein said strip of non-porous material positioned in said slot is formed of galvanized steel.

19. The moisture shield of claim 14 wherein said waterresistive coating material is a water-based acrylic adhesive.

20. The moisture shield of claim 14 wherein said strip of mesh-like material formed of fiber glass.

21. A method for retarding the leaching of liquid-borne minerals and salts in a stucco wall comprising the steps of:

forming a slot of a predetermined depth along said wall;

inserting a water impervious material into said slot; and forming a patch over said slot, said step of forming a patch over said slot comprising the steps of:

applying a strip of a mesh-like material over said slot; and applying a stucco-based material upon said mesh-like material and upon said wall in a region about said slot.

22. The method of claim 4 wherein said stucco wall has an exterior surface and a bottom with said exterior surface intersecting soil in the region adjacent said bottom, said slot being formed in said stucco wall at said exterior surface in a region above where said exterior surface intersects said soil.

23. The method of claim 4 wherein said step of inserting said water impervious material into said slot further comprises the steps of:

inserting a strip of non-porous material within said slot; and disposing an acrylic stucco bonding agent within said slot about said strip.

* * * * *